US005513768A

United States Patent [19]

Smith

[11] Patent Number: 5,513,768

[45] Date of Patent: May 7, 1996

[54] SEALING CAP FOR CONTAINERS

[76] Inventor: James C. Smith, 336 Harder Rd., Hayward, Calif. 94544

[21] Appl. No.: 188,291

[22] Filed: Jan. 28, 1994

Related U.S. Application Data

[63] Continuation-in-part of Ser. No. 918,527, Jul. 20, 1992, Pat. No. 5,295,599.

[51] Int. Cl.[6] ..... A61J 1/00; B65D 55/16

[52] U.S. Cl. ..... 220/259; 215/278; 215/306; 220/375

[58] Field of Search ..... 215/204, 306, 215/273, 277, 278, 279, 317, 320, 341, 352, 270, 271; 220/259, 254, 375, 339, 291, 304, 306, 308, 307

[56] References Cited

U.S. PATENT DOCUMENTS

| | | | |
|---|---|---|---|
| 632,575 | 9/1899 | Kilbourn . | |
| 2,186,908 | 1/1940 | Page et al. . | |
| 2,705,573 | 4/1955 | Zepelovitch . | |
| 2,753,051 | 7/1956 | Tupper . | |
| 2,935,219 | 5/1960 | Smith . | |
| 3,028,985 | 4/1962 | Pope . | |
| 3,055,540 | 9/1962 | Ringlen | 220/307 |
| 3,239,112 | 3/1966 | Porcelli . | |
| 3,430,777 | 3/1969 | Esposito, Jr. . | |
| 3,567,013 | 3/1971 | Lannenbaum . | |
| 3,580,650 | 5/1971 | Morris . | |
| 3,874,541 | 4/1975 | Lagneaux et al. | 215/352 X |
| 4,152,269 | 5/1979 | Babson . | |
| 4,331,255 | 5/1982 | Fournier . | |
| 4,344,545 | 8/1982 | Aschberger et al. . | |
| 4,390,111 | 6/1983 | Robbins et al. . | |
| 4,397,400 | 8/1983 | Walter . | |
| 4,674,640 | 6/1987 | Asa et al. . | |
| 4,718,567 | 1/1988 | La Vange . | |
| 4,735,334 | 4/1988 | Abbott | 220/259 |
| 4,753,358 | 6/1988 | Virca et al. . | |
| 4,896,780 | 1/1990 | Jessop et al. . | |
| 4,956,103 | 9/1990 | Jessop et al. . | |
| 5,000,236 | 3/1991 | Jemison . | |
| 5,103,990 | 4/1992 | Irwin | 220/307 X |
| 5,145,646 | 9/1992 | Tyranski | 220/254 X |
| 5,199,618 | 4/1993 | Reil et al. . | |
| 5,305,900 | 4/1994 | Maguire et al. | 220/254 X |
| 5,322,176 | 6/1994 | Dubach | 220/254 X |

FOREIGN PATENT DOCUMENTS

| | | | |
|---|---|---|---|
| 847947 | 8/1957 | United Kingdom | 220/259 |

*Primary Examiner*—Allan N. Shoap
*Assistant Examiner*—Nathan Newhouse
*Attorney, Agent, or Firm*—Townsend and Townsend and Crew

[57] ABSTRACT

A sealing device for a container is provided with a sealing member that varies the sealing capacity of the device in response to pressure changes within the container.

19 Claims, 7 Drawing Sheets

SEALING CAP FOR CONTAINERS

This is a continuation-in-part application of U.S. patent application Ser. No. 07/918,527 filed Jul. 20, 1992, now U.S. Pat. No. 5,295,599 which is hereby incorporated by reference.

BACKGROUND OF THE INVENTION

The invention relates generally to a sealing device for a container, and more particularly, to a sealing device having a sealing capacity that varies according to the pressure in the container.

Containers such as test tubes have been used to store sample materials such as liquids. Removable caps have been used in conjunction with such tubes to prevent contamination or loss of the sample, while allowing for subsequent re-access to the sample. Typically removable caps rely on friction fit between a cylindrical portion of the cap and the inside surface of the test tube to form a seal between the test tube and cap. Such friction seal caps can be integrally formed with the tube and attached to the tube by a hinge as disclosed in U.S. Pat. No. 4,674,640. However, among the drawbacks of frictional cap seals is their inability to maintain seal integrity when dropped or subjected to heat or cold in which case the internal pressure increases and can break any hermetic seal formed between the cap and tube. As a result, the sample can evaporate, for example. In addition, substantial increases in internal pressure can cause the cap to pop off, resulting in sample loss. Although the sealing strength can be increased by increasing the friction fit between the cap and test tube, such an arrangement makes insertion and removal of the cap much more difficult (something even requiring a tool) and can result in the sample spilling when the cap is abruptly moved upon removal due to the relatively high static friction force.

SUMMARY OF THE INVENTION

The present invention is directed to a seal for a container, such as a disposable centrifuge container, or test tube that avoids the problems and disadvantages of the prior art. The invention accomplishes this goal by providing a sealing member having a generally convex end wall. The sealing member is configured for being inserted in the open end of a tubular member with the generally convex end wall positioned in the tubular member and bulging in a direction away from the open end. With this construction, as the pressure in the tubular member increases, it tends to deflect and flatten the generally convex end wall, thereby causing the perimeter or rim of the end wall to expand radially outward and enhance the seal between the sealing member and the inner wall of the tubular member. As a result, the sealing capacity is increased when it is most needed, i.e., when high pressure within the tubular member develops. In addition, as the pressures in the tubular member increase and deflects the generally convex end wall, the deflection advantageously increases the sealed volume, thereby tending to reduce the internal pressure. Also, as pressure decreases the seal interference decreases and makes for much easier cap removal.

In the preferred embodiment, a mechanism is provided to prevent the generally convex end wall from being deflected beyond a flat configuration and being inverted into a concave configuration where the outer diameter of the end wall would contract, thereby reducing sealing capacity. This mechanism further ensures that the end wall will return to its original generally convex state upon removal of the pressures within the tubular member. When the sealing member is used in conjunction with a multiple cap seal having a sealing cap, comprising the sealing member, and a locking cap that interlocks the sealing and locking caps together, this mechanism preferably comprises a protrusion extending from the locking cap into the sealing member, which preferably is tubular, to a position adjacent to the generally convex end wall. The projection prevents the generally convex end wall from being inverted.

The sealing member also preferably is configured to provide a relatively small ring-to-ring contact area between the sealing member and the inner wall of the tubular member to increase the contact pressure and enhance sealing capacity. In the preferred embodiment, this is accomplished with a sealing member that includes a frustoconical portion adjacent to the generally convex end wall. The frustoconical portion converges in a direction away from the end wall. In the preferred embodiment, a substantially constant diameter annular portion is provided between the end wall and frustoconical portion to form the ring-to-ring seal between the sealing member and the inner wall of the tubular member. However, other sealing arrangements can be used to provide the desired ring-to-ring contact without departing from the scope of the invention. For example, the sealing member can be provided with an O-ring to form the seal with the inner wall of the tubular member.

The sealing member, which in the preferred embodiment includes the frustoconical portion discussed above, preferably is used in conjunction with a tubular member, such as a centrifuge tube, having a frustoconical groove formed in its inner wall. That is, the groove substantially corresponds in dimension to the outer frustoconical surface of the sealing member to improve the sealing capacity when the sealed volume is pressurized. Thus, in the preferred embodiment, the frustoconical groove is formed with its widest dimension furthest from the open end of the tube. In this manner, the sealing member becomes taper-locked into the tubular member. For example, when internal pressures deflect the convex surface of the sealing member, the outside walls of the sealing member are pushed even further outward and in effect the cap becomes taper-locked into the tubular member and cannot be withdrawn. On the other hand, the taper-lock can be continuously effective. For example, when used in conjunction with a multiple cap seal having a sealing cap, comprising the sealing member, and a locking cap as discussed above, the locking cap is configured to slightly expand the sealing cap. In the preferred embodiment, the locking cap is provided with an inner cylindrical member and the inner wall(s) of the sealing member is cylindrically configured to form a friction fit with the locking cap cylindrical member. When the locking cap cylindrical member is inserted into the sealing cap, the cylindrical walls cooperate and form an interference fit. This provides a seal between the locking cap and sealing member, while providing outward pressure of the sealing member against the tubular member. The outward pressure enhances the seal between the sealing member and tubular member, but most notably enhances the taper-lock feature and prevents the sealing member wall to deflect inward without the removal of the locking cap. It should be understood, however, that in some applications such as when the tubular member is glass or when minimal resistance to removing the sealing member from the tubular member is desired, the frustoconical groove and sealing cap portion may not be included.

In the multiple cap embodiment, a hinge arrangement also is provided to enhance seal integrity. In this arrangement the sealing and locking caps, discussed above, are hinged to the tubular member. The sealing cap is pivoted about its hinge and the sealing member positioned in the open end of the tubular member to form a seal therewith. The locking cap is then pivoted about its hinge and positioned over the sealing cap. A locking mechanism that releasably locks the sealing and locking caps together and prevents relative movement therebetween when the sealing cap is positioned in the opening of the tubular member. The hinges are dimensioned such that the combined locked sealing and locking cap structure is precluded from axially moving away from the open end of the tubular member without consequent hinge deformation or failure. In this way, the sealing cap is reliably retained in its sealing position and closure integrity against specimen loss is ensured when relatively high pressures develop in the container, such as when the container is heated, frozen or dropped. Additionally, the sealing caps can readily be removed once the locking mechanism is unlocked.

According to another aspect of the invention the locking cap is provided with a cylindrical member that closely fits into the cup-shaped member. This arrangement prevents significant lateral movement between the caps and can be constructed to provide a frictional fit sufficient to lock the caps together. Alternatively, the locking mechanism can comprise a detent arrangement and the cooperating elements provided on the cylindrical and cup-shaped members such that the sealing and locking caps are automatically locked together when the cylindrical member is seated in the cup-shaped member. In a further embodiment the locking mechanism comprises a latch arrangement having in a latch arm provided on the locking cap and the latch lip provided on the container. In this case, as the cylindrical member is introduced into the cup-shaped member, these members cooperate and guide the locking cap to align the latch mechanisms into engagement.

Another feature of the present invention is a syringe access provided in the sealing cap. The container can be accessed by removing the locking cap and penetrating the syringe access with the syringe. The container then can be hermetically resealed by merely re-engaging the locking cap with the sealing cap when the caps are constructed to provide a hermetic seal therebetween. Alternatively both the first and second caps can have syringe ports.

It should be understood that the language used in the specification has been chosen to aid in disclosure, and not to limit the inventive subject matter. For example, the term "tube" is used to designate the object to be sealed, but containers such as bottles or open-ended objects such as pipes can also be sealed with the present invention.

The above is a brief description of some deficiencies in the prior art and advantages of the present invention. Other features, advantages and embodiments of the invention will be apparent to those skilled in the art from the following description, accompanying drawings and appended claims.

Figure 13A:
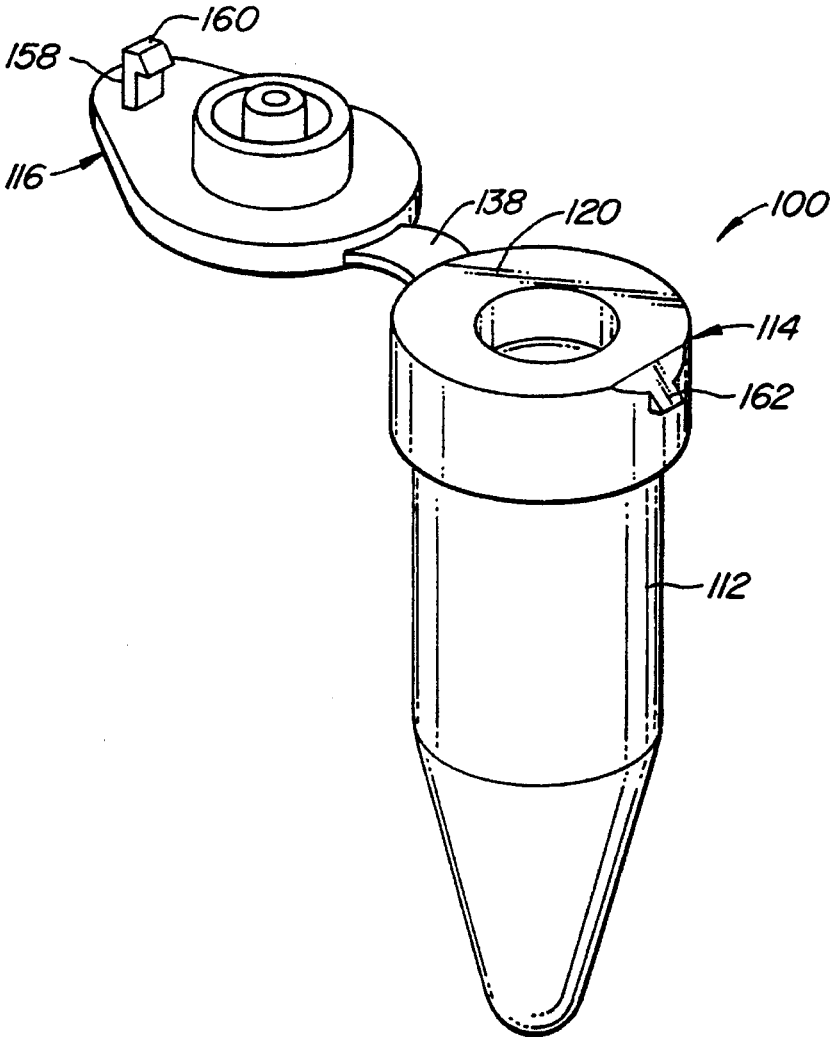
FIG. 13A is a perspective view of another embodiment of the multiple cap seal of the present invention.
Figure 14:
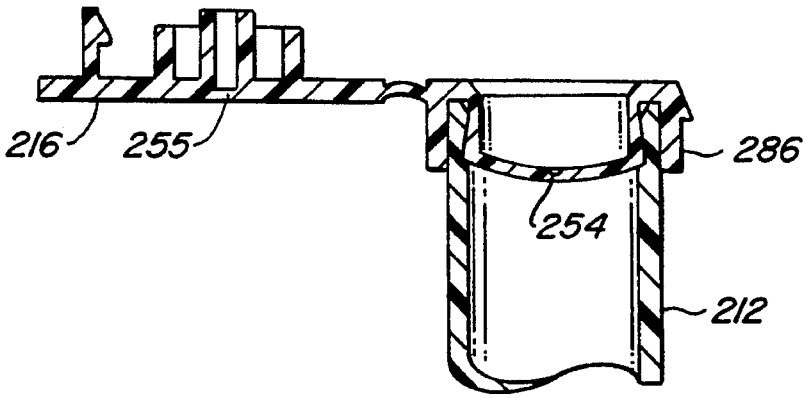
Figure 15:
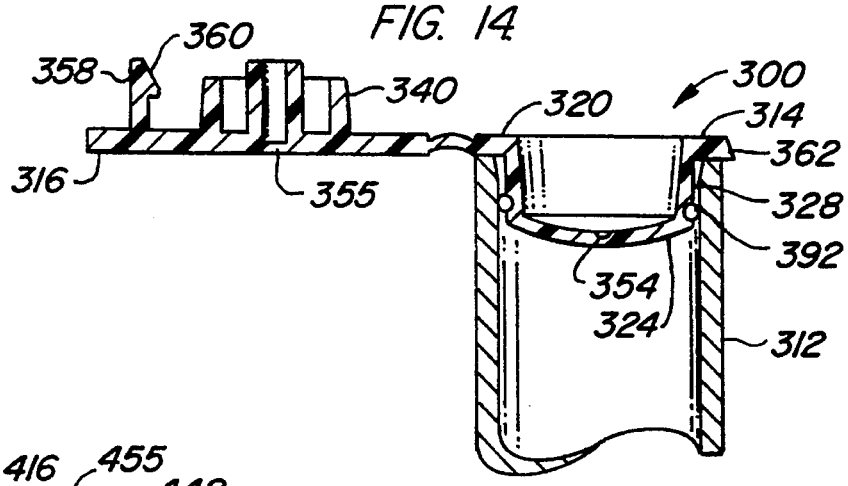
Figure 16:
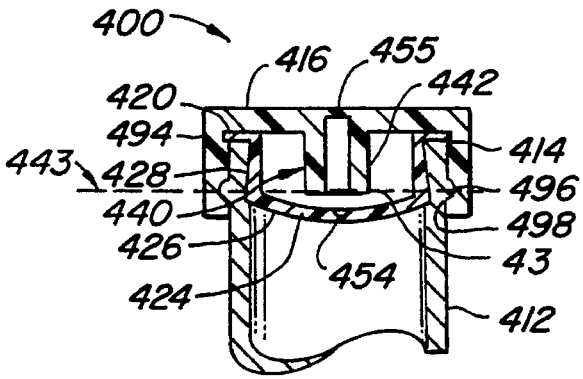

Pig. 13B is a longitudinal section of the multiple cap seal of FIG. 13A;

FIG. 14 is a longitudinal section of yet another embodiment of the multiple cap seal of the present invention;

FIG. 15 is a longitudinal section of a further embodiment of the multiple cap seal of the present invention; and FIG. 16 is a longitudinal section of yet a further embodiment of the multiple cap seal of the present invention.

DESCRIPTION OF THE PREFERRED EMBODIMENT

Referring to the drawings in detail, wherein like numerals indicate like elements, FIGS. 1–8 show a multiple cap sealing arrangement constructed in accordance with the principles of the present invention. The sealing arrangement generally includes multiple cap seal 10 and tube or container 12. Multiple cap seal 10 includes a sealing cap 14, a locking cap 16, and a collar 18. Both caps 14 and 16 are hingedly attached to collar 18, which includes an aperture or opening 19 that forms the opening of open-ended tube or container 12. Although tube 12 is shown as a disposable centrifuge container, it should be understood that the multiple cap seal can be used in conjunction with other containers such as pipes or bottles and the like. Preferably, the tube and multiple cap seal arrangement are integrally formed as a one-piece structure, such as by injection molding, and comprise polypropylene or polyethylene.

Sealing cap 14 includes a generally flat base member or flange 20, attached or coupled to collar 18 by hinge 22, and a tubular or cup-shaped sealing member 24 sized to fit through opening 19 and into tube 12. Cup-shaped member 24 extends from flange 20 and includes bottom wall 26, annular rim 27 having a substantially constant outer diameter, and side wall 28 that form a chamber or recess 29 for receiving a portion of locking cap 16 as will be discussed in detail below. The end of flange 20 opposite hinge 22 extends outwardly forming two tabs 30. Tabs 30 are pushed upwardly to facilitate the removal of sealing cap 14 from test tube 12.

Figure 1:
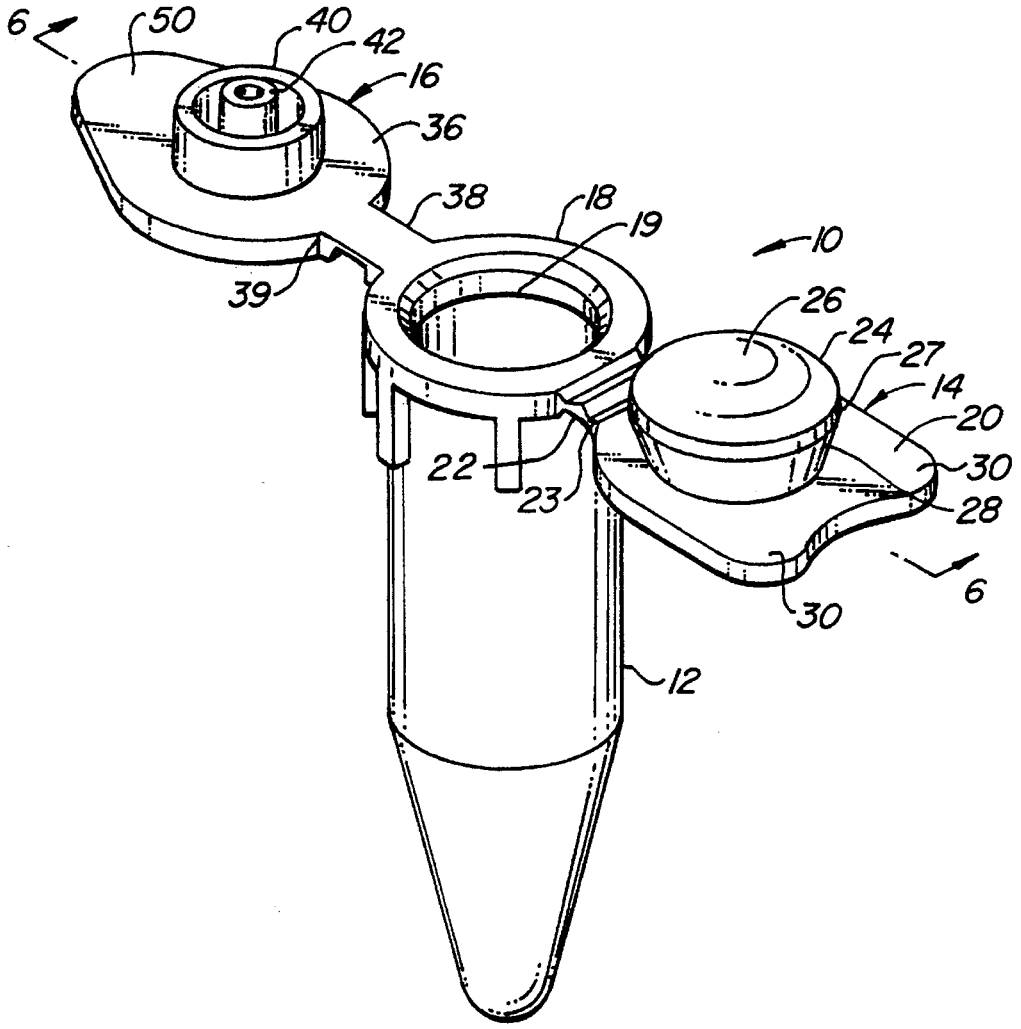
FIG. 1 is a perspective view of a multiple cap seal constructed according to the principles of the present invention.
Figure 2:
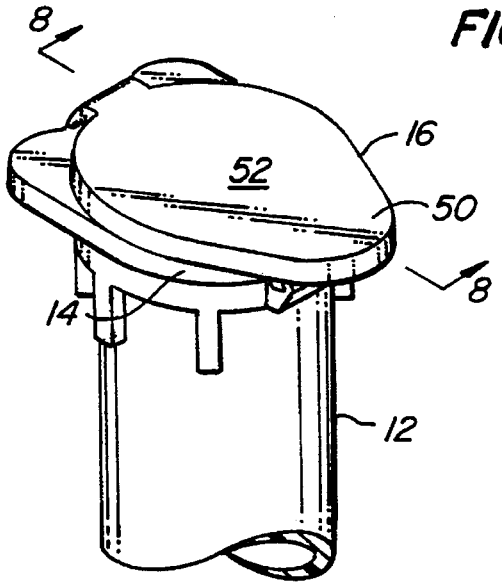
FIG. 2 is a perspective view of the multiple cap seal of FIG. 1 in a sealed or closed state.
Figure 3:
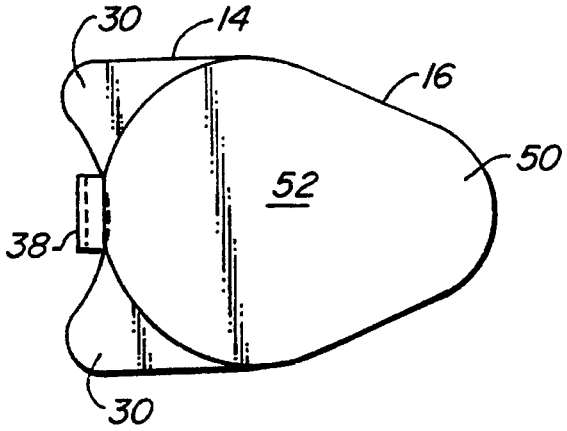
FIG. 3 is a top view of the multiple cap seal illustrated in FIG. 2.
Figure 4:
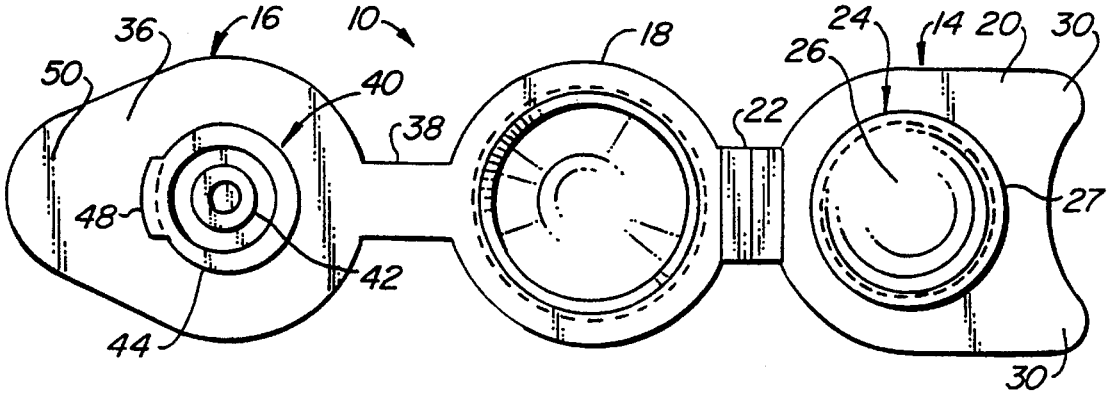
FIG. 4 is a top view of the multiple cap seal of FIG. 1.
Figure 5:
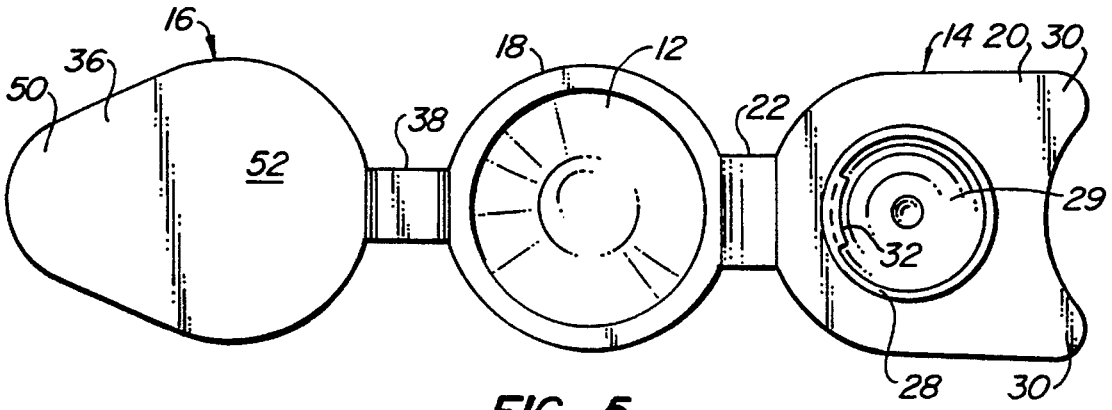
FIG. 5 is a bottom view of the multiple cap seal of FIG. 1.
Figure 6:
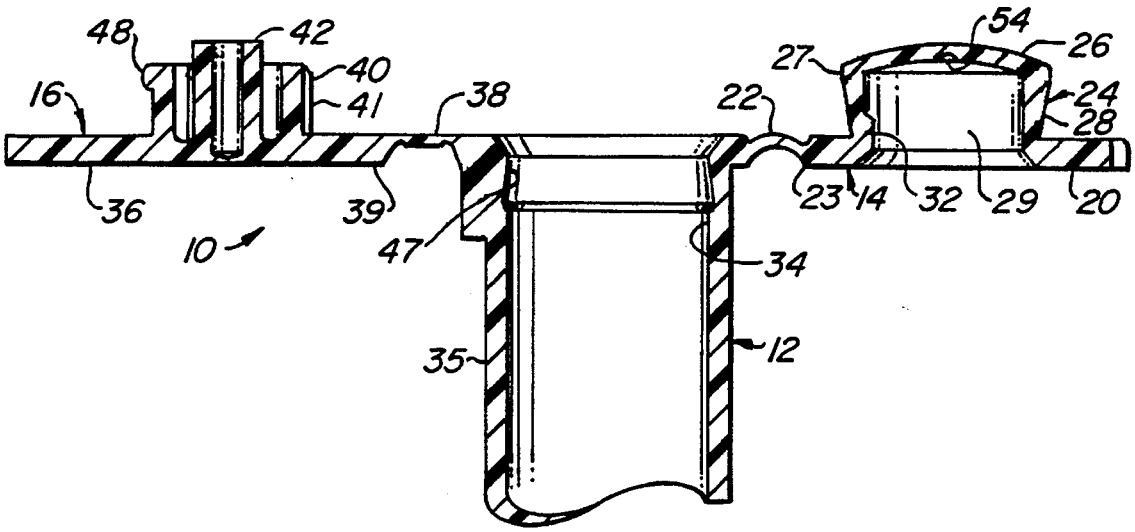
FIG. 6 is a longitudinal section of the multiple cap seal of FIG. 1.

Bottom wall 26 is convex when in a relaxed state, as shown, for example, in FIG. 6 where bottom wall 26 is shown bulging outwardly relative to cavity or chamber 29 and flange 20. With this construction, as the pressure in the tubular member increases, it tends to deflect and flatten the generally convex end wall, thereby causing the perimeter or rim of the end wall to expand radially outward and enhance the seal between the sealing member and the inner wall of the tubular member. As a result, the sealing capacity is increased when it is most needed, i.e., when high pressure within the tubular member develops. In addition, as the pressure in the tubular member increases and deflects the generally convex end wall, the deflection advantageously increases the sealed volume, thereby tending to reduce the internal pressure.

Cup-shaped member 24 preferably is configured to provide relatively small ring-to-ring contact area between cup-shaped member 24 and inner wall surface 34 of tube 12 to increase the contact pressure and enhance sealing capacity. To this end, the outer surface of cup-shaped member 24 preferably is frustoconically shaped. Substantially constant diameter annular portion 27 is provided between the frustoconical portion and convex end wall of cup-shaped member 24. Annular portion 27 forms the largest diameter portion of cup-shaped member 24 for forming the ring-to-ring seal discussed above. Annular portion 27 preferably is adjacent convex end wall 26 as this position is believed to be most responsive to end wall deflection. It should be understood, however, that other configurations can be used to provide the desired ring-to-ring seal without departing from the scope of the invention. For example, an annular groove can be formed in side wall 28 and an O-ring comprising natural rubber or an elastomeric material seated therein to form the seal between cup-shaped member 24 and inner wall surface 34 of tube 12.

Cup-shaped member 24 also is configured to fit readily into opening 19 and, thus, the open end of tube 12. However, cup-shaped member 24 preferably is sized to provide a slight frictional fit between rim 27 and inner wall surface 34 of tube 12. To this end, the outer diameter of annular portion 27 is sized to be about 0.001 to 0.005 inch greater than the inner diameter of tube 12 when the sealing member and the tube comprise plastic such as polypropylene. In any case, the fit should not be so tight so as to unduly restrict relative movement between cup-shaped member 24 and tube 12 during insertion or removal of sealing cap 14.

Figure 7:
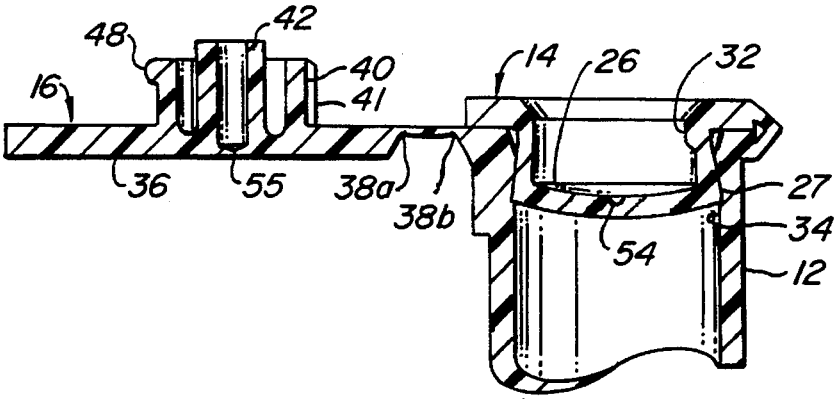
FIG. 7 is a longitudinal section of the multiple cap seal of FIG. 1 in a partially closed position.
Figure 10:
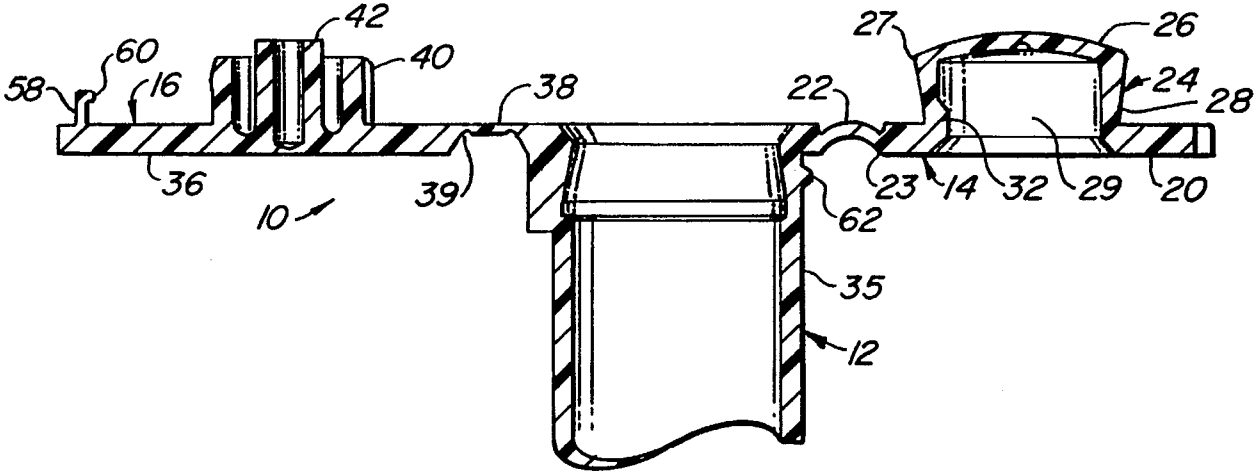
FIG. 10 is a longitudinal section of the multiple cap seal of FIG. 9.

Locking cap 16 includes a generally flat base member or flange 36, which is attached or coupled to collar 18 by hinge 38 and protrusions 40 and 42. One side of member 36 has a generally flat surface, whereas the opposite side of member 36 has protrusions 40 and 42 extending therefrom. Protrusions 40 and 42 have a generally cylindrical shape and are concentrically positioned relative to one another as can be seen, for example, in FIGS. 1 and 4. Projection 40 is sized such that when seated in chamber 29 lateral movement of locking cap 16 is substantially prevented. To this end, projection 40 can be provided with rib 41 as shown in FIGS. 6 and 7. However, when a hermetic seal is desired projection 40 is sized so that its outer surface forms a continuous interference fit with the inner wall(s) of the sealing member (i.e., rib 41 is eliminated) as shown in FIG. 10. The end of flange 36 opposite hinge 38 extends outwardly forming a tab 50, which, when pushed upwardly, facilitates removal of locking cap 16 from sealing cap 14.

Figure 8B:
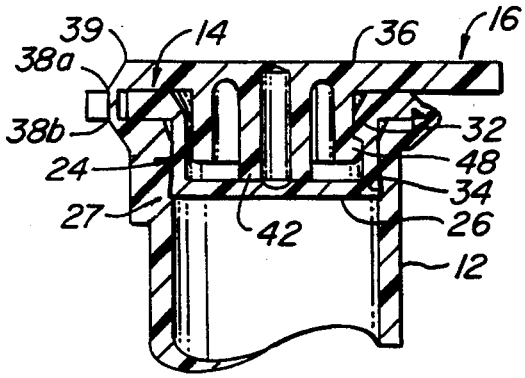
FIG. 8B is a longitudinal section of the multiple cap seal of FIG. 8A with the sealing member bottom wall deflected.
Figure 8A:
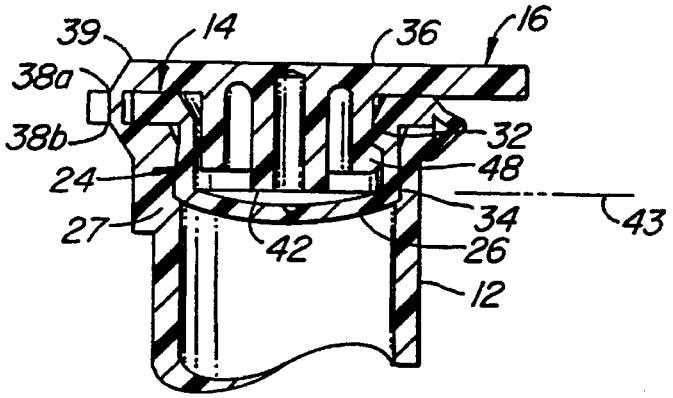
FIG. 8A is a longitudinal section of the multiple cap seal of FIG. 1 in a fully closed position.

Referring to FIGS. 8A and B, the length of inner cylindrical protrusion 42 is selected such that when the locking cap is fully seated, the distal end of protrusion 42 is positioned adjacent convex end wall 26 and generally along the plane defined by the juncture between the inner surface of side wall 28 and convex wall 26 and generally designated with reference numeral 43. In this manner, protrusion 42 acts as a stop member and prevents convex end wall 26 from being significantly deflected beyond the flat configuration shown in FIG. 8B and inverted into a concave configuration in response to increasing internal pressures. Otherwise, the outer diameter of the end wall would contract, thereby reducing sealing capacity. Protrusion 42 further ensures that end wall 24 will return to its original generally convex state when the pressure within tube 12 decreases.

Referring to FIGS. 1–8, the multiple cap seal system is shown with a taper-lock between the sealing and tubular members. More specifically, the outer surface of side wall 28 is frustoconical and a groove 47 of corresponding dimension is provided in the inner wall of tube 12 to mate therewith. The widest dimension of frustoconical groove 47 is furthest from the open end of the tube as shown in FIG. 6, for example. In this manner, the sealing member becomes taper-locked into the tubular member. For example, when internal pressures deflect the convex surface of the sealing member, the outside walls of the sealing member are pushed even further outward and in effect the cap becomes taper-locked into the vessel of tubular member and cannot be withdrawn. On the other hand, the taper-lock can be continuously effective. For example, when used in conjunction with a multiple cap seal having a sealing cap, comprising the sealing member, and a locking cap as discussed above, the locking cap is configured to slightly expand the sealing cap. In the preferred embodiment, the locking cap is provided with an inner cylindrical member and the inner wall(s) of the sealing member is cylindrically configured to form a friction fit with the locking cap cylindrical member. When the locking cap cylindrical member is inserted into the sealing cap, cylindrical walls cooperate and form an interference fit. This provides a seal between the locking cap and sealing member, while providing outward pressure of the sealing member against the tubular member. The outward pressure enhances the seal between the sealing member and tubular member, but most notably enhances the taper-lock feature and prevents the sealing member wall to deflect inward without the removal of the locking cap. It should be understood, however, that in some applications, such as when the tubular member is glass or some other hard material or when minimal resistance to removing the sealing member is desired, the frustoconical groove and sealing cap portion may not be included.

Various mechanisms can be used to interlock sealing cup 14 and locking cap 16 together to ensure that protrusion 42 serves its intended purpose and further enhance the locking of cup-shaped member 24 in its sealing position. Referring to FIGS. 1–8, outer protrusion 40 can be provided with a tab 48 that protrudes radially outward for engaging a ridge 32 that protrudes from the inner surface of cup-shaped member wall 28 toward the center of cavity 29. Tab 48 and ridge 32 are configured to form a detent mechanism such that tab 48 slides over and snaps into place under ridge 32 to facilitate retention of the sealing and locking caps in their closed position (FIGS. 8A and B). In this way, the locking cap and sealing cap are releasably locked together and relative movement therebetween prevented (e.g., the sealing and locking caps 14, 16 are prevented from pivoting about hinges 22, 38).

Although a detent mechanism has been described to secure or lock the locking cap to the sealing cap, other mechanisms can be used. For example, projection 40 can include a plurality of ribs 41 circumferentially spaced about its outer wall and sized to sufficiently frictionally engage the inner surface of wall 28 of the cup-shaped member as discussed above with reference to FIGS. 6 and 7. Alternatively, the outer diameter of protrusion 40 can be sized so that locking cap 16 frictionally engages the inner surface of wall 28 to the extent necessary to keep the caps secured to one another. As shown in the drawings, these mating surfaces also are similarly configured (i.e., both are cylindrical) in the preferred embodiment to enhance the friction fit. A latch mechanism is a further alternative, and is described in detail below.

Figure 9:
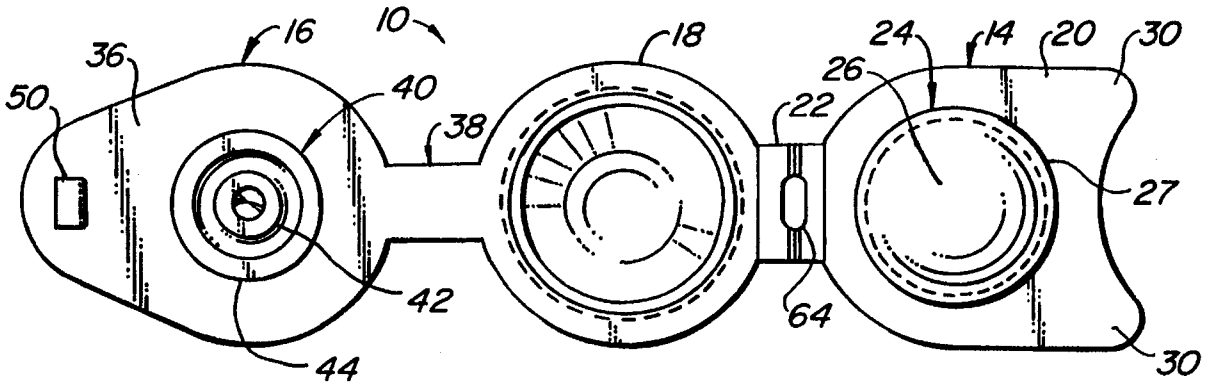
FIG. 9 is a top view of a multiple cap seal constructed according to another embodiment of the present invention.

Referring to FIGS. 9 and 10, the aforementioned latch-type retaining mechanism is shown. This mechanism also facilitates securing sealing and locking caps 14,16 together to prevent relative movement therebetween when the caps are in the closed position. This retaining mechanism comprises an elongated member or latch arm 58, which includes lip 60, and ridge 62. Latch arm 58 extends from the underside of flange 36 of locking cap 16, while ridge 62 is formed on the outer surface 35 of tube 12. When the sealing and locking caps are placed in their closed positions (in the opening of tube 12), latch arm 58 extends past or through opening 64 in hinge 22 where lip 60 slides over and snaps into place under ridge 62 such that locking cap 16 is releasably locked to tube 12. Projection 40 and cavity 29 are positioned and configured such that the latch arm is guided into engagement with ridge 62 as projection 40 slides into cavity 29, as evident from the drawings. When latch arm 58 is coupled to lip 62, flange 36 of locking cap 16 abuts flange 20 of sealing cap 14. Thus, sealing cap 14 is prevented from moving away from tube 12. Additionally, since sections of flange 20 of sealing cap 14 abut collar 18 (FIGS. 7 and 8), further movement by sealing cap 14 toward tube 12 is prevented. Accordingly, the sealing and locking caps are locked together such that relative movement therebetween is prevented.

Once the locking cap has been secured to the sealing cap with any of the retaining mechanisms described above, hinges 22 and 38 work in conjunction with the retaining mechanism to prevent the interlocked cap structure from being displaced axially away from the tube. Hinge 22 interconnects sealing cap 14 and container 12 at region 23, while hinge 38 interconnects container 12 and locking cap 16 at region 39 (See e.g., FIGS. 6 and 10). The length of hinge 22 is selected such that when cap 14 has been placed in its closed position, axial movement of region 23 of sealing cap 14 away from the open end of container 12 is prevented due to the hinge's resistance to stretch. Referring to FIG. 7, when cap 14 is placed in its closed position it extends from the open end of the container a distance equal to the thickness of flange 20. Accordingly, hinge 22 is constructed to have a length substantially equal to the thickness of flange 20 to prevent region 23 from moving away from collar 18. The length of hinge 38 is such that it similarly precludes any significant movement of region 39 of locking cap 16 away from the open end of the container, when the second cap has been placed in its closed position. As illustrated in the drawings, hinges 22 and 38 are circumferentially spaced about 180° from one another. When hinges 22 and 38 are spaced as such, the combined locking and sealing cap combination is prevented from pivoting. Additionally, hinge 38 preferably is provided with two pivot points 38*a*, 38*b* (FIG. 7) that are spaced apart a distance essentially equal to the thickness of sealing cap flange 20 so that the locking cap flange 36 can lay flat upon flange 20 as illustrated in FIGS. 8A and 8B. This enhances the distribution of forces between the flanges and transfer of stresses to hinges 22 and 38. Also, this construction permits uniform compression of sealing cap flange 20 by locking cap flange 16 to enhance the seal between flange 20 and collar 18.

It has been found that with the above hinge and cap interlock combination, forces within the container can dislodge the locking and sealing caps from their closed position only if hinge 22 or hinge 38 is broken. For example, cap 24 cannot be dislodged while hinge 22 is intact since cap 24 is held in place by locking cap 16 and hinge 38. The hinges are constructed such that substantial force is required to break a hinge. Thus, the combined effect of hinges 22 and 38, and either retainer (e.g., the above-described detent or latch mechanism) serves to securely retain the locking and sealing caps within the open end of a container.

Merely to exemplify a preferred makeup of components that have been found to produce the desired effects, the following example may be recited. It is understood that this example is given by way of illustration and is not intended to limit the scope of this invention. Hinge 22 has a length of about 0.134 inch, while hinge 38 has a length of about 0.130 inch. The wall thickness of each flange 20, 36 is about 0.050 inch, while the wall thickness of tube 12 is about 0.035 inch. The inner diameter of tube 12 in the region adjacent the open end, where it is smallest, is about 0.367 inch. In the relaxed state, the largest outer diameter of frustoconical wall 28 adjacent rim 27 is about 0.372 inch and the outer diameter of wall 28 at its base adjacent flange 20 is about 0.362 inch. Although other materials may be used, the cap and tube assembly is preferably polypropylene.

Figure 11:
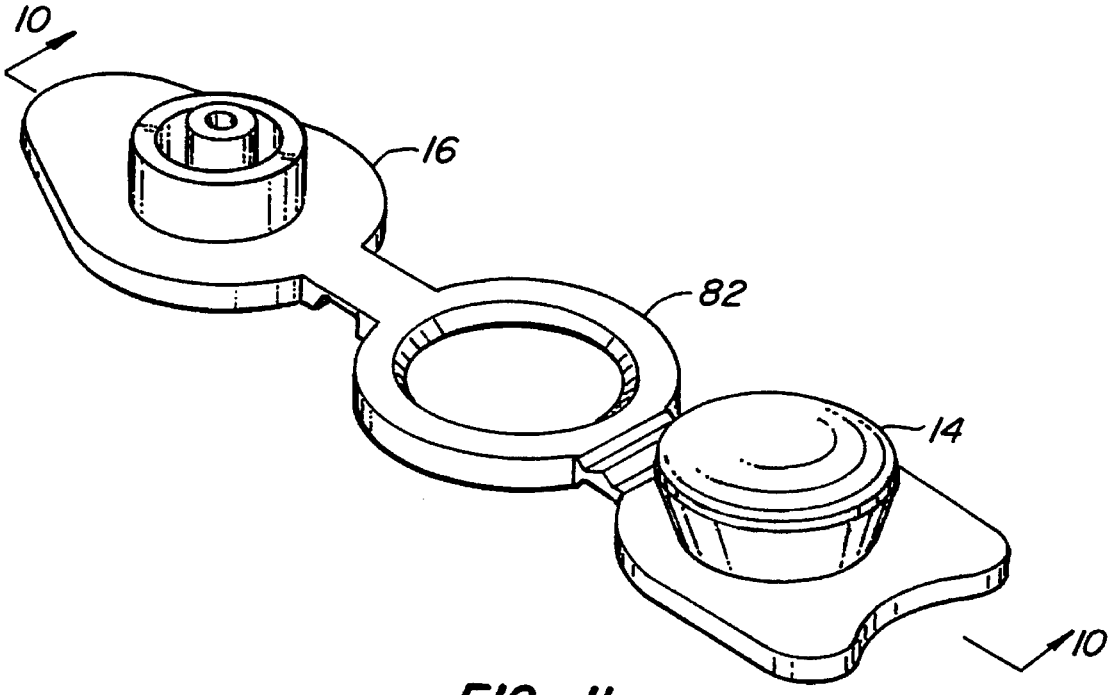
FIG. 11 is a perspective view of a multiple cap seal constructed according to a further embodiment of the present invention.
Figure 12:
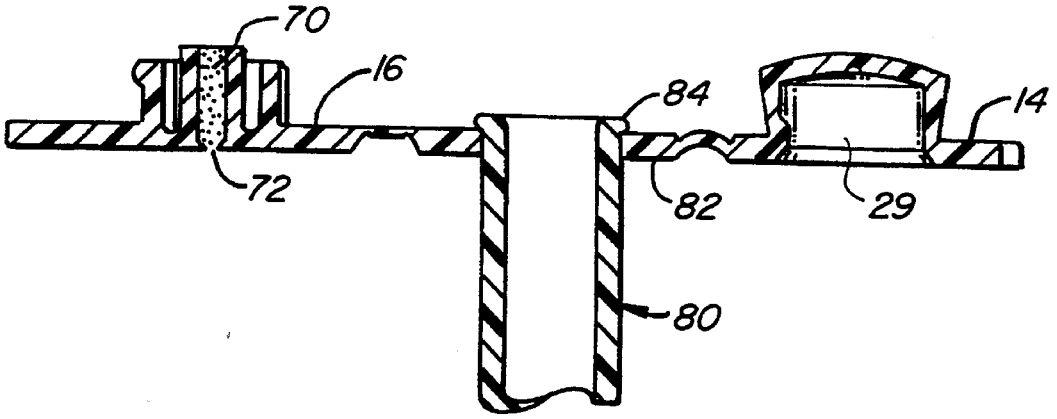
FIG. 12 is a longitudinal section of the multiple cap seal of FIG. 11 coupled to a tube.

As noted above, the multiple cap seal need not be integrally-molded with a tube or container. Referring to FIGS. 11 and 12, the multicap seal is shown as a discrete element provided with a collar 82 having an opening sized to accommodate container 80. It is important, however, that the collar is sufficiently secured to container 80 such that the collar does not become separated from tube 80 when the hinges are under load. Referring to FIG. 12, retaining lip 84 is provided to prevent collar 82 from unintentionally slipping off tube 80. The locking cap 16 and sealing cap 14 of this embodiment are configured as described above. However, other mechanisms can be used to secure collar 82 to container 80.

A syringe access mechanism can be provided in any of the embodiments described above. Referring to FIG. 7, for example, a syringe port or access mechanism 54 is shown in the bottom wall 26 of the sealing cap 14. As is evident from the drawings, syringe port 54 is in the form of a recess in the wall. The recess forms a reduced wall thickness section that facilitates syringe penetration through the bottom wall 26 of sealing cap 14 such that the syringe can be readily inserted into the tube without removing sealing cap 14. A section 55 of locking cap 16 also is provided with a reduced wall thickness. If only syringe port 54 is used, and syringe access mechanism 55 remains unused and, thus, sealed, locking cap 16 can then be reinserted into cup-shaped member 24 to once again hermetically seal the tube provided an appropriate seal is formed between the sealing cap and locking cap. Such a seal can be accomplished by providing a continuous frictional fit between protrusion 40 and the inner surface of cup-shaped member side wall 28 as discussed above.

A ventilating filter also can be provided in any of the embodiments described above. Referring to FIG. 12, for example, a filter 70 and opening 72 can be provided in the locking cap to allow the contents of the tube to be ventilated.

Referring to FIGS. 13–16, further embodiment of the multiple cap seal are shown. Elements which correspond to those discussed with reference to multiple cap seal 10 are designated with corresponding numerals in 100, 200, 300 and 400 series to aid in description of the embodiments.

Figure 13B:
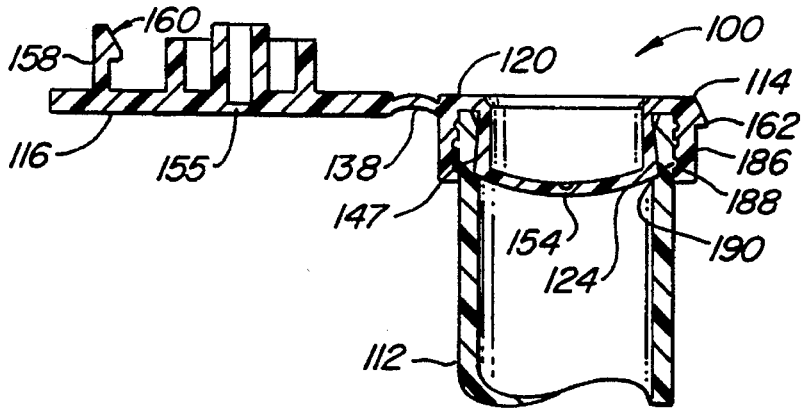

Referring to FIGS. 13A and B, multiple cap seal 100 includes sealing cap 114 and locking cap 116. Sealing cap 114 differs from sealing cap 14 discussed above in the way sealing cap 114 is coupled to tubular member 112. That is, sealing cap 114 is not hingedly coupled to tubular member 112. Rather, sealing cap 114 is threadably coupled to tube 112. More specifically, sealing cap 114 includes a generally flat, annular base member 120 from which cup-shaped member 124 and annular flange 186 extend. Cup-shaped member 124 is the same as cup-shaped member 24. Annular flange 186 includes annular threaded portion 188 which is provided on the internal surface of flange 186 and configured to mate with threaded portion 190 which is provided on the outer circumference of tubular member 112. Tubular member 112 is shown in frustoconical groove 147 which is the same as groove 47. Sealing cap 114 also includes ridge 162 which extends radially therefrom for interlocking with lip 160 of latch arm 158 of locking cap 116 when the locking cap is disposed in the sealing cap. Locking cap 116 is the same as locking cap 16. Hinge 138 couples locking cap 116 to sealing cap 114 and has the same construction as hinge 22. Thus, hinge 138 prevents the portions of the sealing and locking caps adjacent thereto from moving axially from one another when the locking cap is positioned in the sealing cap. Although the end wall of cup-shaped member 124 need not be convex, as shown in FIG. 13, due to the sealing capacity obtained through the threaded connection, the convex configuration is preferred as it improves the seal and provides a fall-back locking mechanism when pressure increases within tubular member 112 as discussed above. Multiple cap seal 100 (and those shown in FIGS. 14–16) preferably include a syringe access mechanism 154 (254, 354 and 454) and a reduced section 155 (255, 355 and 455) which has the same construction as corresponding elements 54 and 55 which are discussed above with reference to FIG. 7. The locking cap advantageously provides an effective seal with the tubular member after the sealing cap syringe access mechanism is punctured. Also by accessing the sample in the vial through a puncture hole, a minimum of air loss occurs which can increase the longevity of the sample in a sealed container. Air exchanges may also breed cross contamination between samples which is minimized by this design.

This screw cap configuration, provides improved sealing and allows the samples contained in tubes with this sealing arrangement to be shipped through the mail (i.e., threaded caps are post office approved). The syringe access also eliminates the need to remove the threaded sealing cap for access to the sample in tubular member 112. This is important, since removing the sealing cap completely can sometimes cause cross-contamination as a result of mistakenly putting another cap back on the container. Also typical threaded caps require two hands for removal (one to hold the container and the other to unscrew the cap) while this pop top version requires only one hand to use as in the standard single hinged vials.

Referring to FIG. 14, multicap seal 200 differs from the multiple cap seal of FIG. 13 only in that a press fit connection is substituted for the threaded connection between the sealing and tubular members. That is, annular flange 286 has a smooth inner surface and is configured to form a press fit onto the smooth exterior surface of tubular member 212. Alternatively, the annular flange and tubular member can be configured to include a mating ridge and recess to provide a snap fit.

Referring to FIGS. 15 and 16, multiple cap seals 300 and 400 also differ from multiple cap seal 10 in the way they are coupled to the sample containing member. Multiple cap seal 300 includes sealing cap 314, locking cap 316 and hinge 338, which is the same as hinge 138 and couples the sealing and locking caps together. Sealing cap 314 essentially differs from sealing cap 114 in that an O-ring is substituted for the threaded flange to secure the sealing member in tubular member 312. In addition the sealing member, cup-shaped member 324 differs from cup-shaped member 24 in that the walls of member 324 are not frustoconical. More specifically, sealing cap 314 includes a generally flat annular base member 320 from which annular side wall 328 of cup-shaped member 324 extends. The outer surface of side wall 328 is generally parallel to the inner surface of tube 312 and includes an annular recess for receiving O-ring 392, which comprises elastomeric material and forms a continuous seal between tubular member 312 and the sealing cap. As the pressure in tubular member 312 increases, convex end wall 326 deflects and compresses O-ring 392 against the inner wall of tubular member 312 to enhance the seal therebetween. The inner surface of side wall 328 tapers toward convex end wall 326. Outer projection 340 has a corresponding taper to cooperate therewith. It should be understood, however, that although this configuration is preferred as it enhances the alignment of projection 340 into sealing cap 314, for example, other cooperating surface configurations can be used. However, it is important that outer projection 340 is sized to provide an interference fit with the inner surface of side wall 328 so that projection 340 expands wall 328 and compresses O-ring 392 against wall 312. Otherwise, locking cap 316 is essentially the same as locking cap 16. Sealing cap 314 also includes ridge 362 with which lip 360 of latch arm 358 lockingly mates.

Multiple cap seal is especially advantageous when the multiple cap seal is to be used in conjunction with vessels or tubes, such as glass or extruded metal tubes, which generally cannot practically be made with frustoconical grooves to provide the taper-lock discussed above.

Referring to FIG. 16, a two-piece multiple cap seal is shown in which the sealing cap and locking caps 414 and 416 are separate members that are releasably attached to tubular member 412. Multiple cap seal 400 includes sealing and locking caps 414 and 416. Sealing cap 414 includes a generally flat, annular base member 420 from which cup-shaped member 424 extends. Cup-shaped member 424 is the same as corresponding member 24. Locking cap 416 differs from corresponding member 116 in that no hinge extends from cap 416, both projections 440 and 442 generally extend to the plane that intersects the juncture between convex end wall 426 and side wall 428 (i.e., plane 443), and annular flange 494 extends from base member 420. As shown in FIG. 16, annular flange 494 is concentric with projections 440 and 442. Annular flange 494 also includes an annular recess 496 that receives annular lip 498 to lock the locking and sealing caps to tube 412. In use, sealing cap 414 is attached to locking cap 416. Then the locking cap is positioned over the end of tube 412 and snapped into place such that lip 498 is seated in groove 496. As discussed above, one may forgo the frustoconical groove in the neck of tube 412 and the frustoconical configuration of member 424 as the application requires. This design allows for use of a softer more pliable material to be used for the sealing cap, 414, while a harder material can be used for locking cap 416.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A sealable container comprising:

a tubular member having an open end and an inner wall;

a closed container having an opening;

means mounting the tubular member to the opening of the closed container;

a sealing cap coupled to said tubular member, said sealing cap including a base and a cup-shaped member extending from said base, said cup-shaped member having an open end adjacent said base and a closed end comprising a generally convex wall, said generally convex end wall bulging outwardly in a direction away from said open end of the cup-shaped member and being configured to occlude said tubular member when said cup-shaped member is inserted through the open end of said tubular member; and a locking cap coupled to said tubular member, said locking cap having a portion configured for being received within said cup-shaped member and sized to prevent said convex wall from being inverted into a concave configuration when said cup-shaped member is positioned in said tubular member and said portion of said locking cap is positioned within said cup-shaped member.

2. The container of claim 1 wherein said generally convex end wall is imperforate.

3. The container of claim 2 wherein said cup-shaped member is flexible.

4. The container of claim 3 wherein said cup-shaped member includes a tubular section between said base and generally convex end wall, said tubular section having a frustoconical outer wall surface, the diameter of said outer wall surface adjacent said generally convex end wall being greater than the diameter of said outer wall surface adjacent said base.

5. The container of claim 4 wherein said cup-shaped member includes an annular outer surface of substantially constant diameter between said generally convex end wall and said frustoconical outer wall surface.

6. The container of claim 1 wherein said cup-shaped member includes a tubular section between said base and generally convex end wall, said tubular section having a frustoconical outer wall surface, the diameter of said outer wall surface adjacent said generally convex end wall being greater than the diameter of said outer wall surface adjacent said base.

7. The container of claim 6 wherein said cup-shaped member includes an annular outer surface of substantially constant diameter between said generally convex end wall and said frustoconical outer wall surface.

8. The container of claim 6 wherein said inner wall of said tubular member includes a groove in the vicinity of said open end of said tubular member, said groove generally corresponding in configuration with said frustoconical outer wall surface for cooperating therewith, the diameter of said groove generally increasing in the direction away from said open end of said tubular member.

9. The container of claim 1 wherein said locking cap includes a base and a projection extending from said base, said projection having first and second portions being sized so that when said cup-shaped member is positioned in said tubular member and said locking cap portion is positioned in said cup-shaped member, said first portion extends to a position adjacent said generally convex end wall to prevent said generally convex end wall from being inverted into a concave configuration and said second portion frictionally engages an inner surface of the cup-shaped member to urge the cup-shaped member radially outward in sealing relation towards the tubular member.

10. The sealable container according to claim 1 and wherein:

the means mounting the tubular member to the opening of the closed container includes means for releaseably mounting the tubular member to the opening.

11. A sealable device comprising:

a tubular member having an open end and an inner and outer wall;

a sealing cap coupled to said tubular member, said sealing cap including a base and a cup-shaped member extending from said base, said cup-shaped member having an open end adjacent said base and a closed end which comprises a generally convex end disposed away from said open end and toward the inner wall and which is configured to seal said tubular member when said cup-shaped member is inserted through the open end of said tubular member;

a locking cap having a projection configured for being received within said cup-shaped member, said projection having a first portion sized to frictionally engage an inner surface of said cup-shaped member and a second portion sized and arranged to prevent said convex wall from being inverted into a concave configuration when said cup-shaped member is positioned in said tubular member and said projection is positioned within said cup-shaped member; and a flexible member having one end coupled to said sealing cap and another end coupled to said locking cap.

12. The device of claim 11 wherein said locking cap is hingedly secured to said sealing cap.

13. The device of claim 11 wherein said end wall is generally convex and bulges outwardly in a direction away from said open end of the cup-shaped member.

14. The device of claim 11 wherein said cup-shaped member includes a tubular section between said base and said end wall, said tubular section having a frustoconical outer wall surface.

15. The device of claim 11 wherein said locking cap portion includes a projection sized so that when said cup-shaped member is positioned in said tubular member and said locking cap portion is positioned in said cup-shaped member, said projection extends to a position adjacent said end wall to prevent said end wall from bulging inwardly toward said open end of the cup-shaped member.

16. The device of claim 11 wherein said cup-shaped member includes an annular recess and an O-ring positioned in said recess.

17. The device of claim 11 wherein said sealing member includes an annular member that surrounds said cup-shaped member, said annular member being sized to fit around said open end of the tubular member.

18. The device of claim 17 wherein said outer wall of the tubular member includes threads and said annular member includes threads arranged to cooperate with said threads on the tubular member to secure the sealing cap to the tubular member.

19. The device of claim 17 wherein said annular member is configured to form a press fit with the outer wall of the tubular member.

* * * * *